US009059504B2

(12) United States Patent
Eom et al.

(10) Patent No.: US 9,059,504 B2
(45) Date of Patent: Jun. 16, 2015

(54) ANTENNA APPARATUS OF MOBILE TERMINAL

(75) Inventors: Sang-Jin Eom, Gyeonggi-do (KR); Ho-Saeng Kim, Gyeonggi-do (KR); Jin-Kyu Bang, Gyeonggi-do (KR); Hyun-Jun Jang, Gyeonggi-do (KR); Min-Kyung Lee, Gyeonggi-do (KR); Kyung-Moon Seol, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 220 days.

(21) Appl. No.: 13/466,609

(22) Filed: May 8, 2012

(65) Prior Publication Data

US 2013/0050038 A1 Feb. 28, 2013

(30) Foreign Application Priority Data

Aug. 25, 2011 (KR) ..... 10-2011-0085046

(51) Int. Cl.

| | |
|---|---|
| ***H01Q 1/38*** | (2006.01) |
| ***H01Q 1/24*** | (2006.01) |
| ***H01Q 1/20*** | (2006.01) |
| ***H01Q 9/42*** | (2006.01) |

(52) U.S. Cl.

CPC ..... *H01Q 1/243* (2013.01); *H01Q 1/20* (2013.01); *H01Q 1/38* (2013.01); *H01Q 9/42* (2013.01); *H01Q 5/35* (2015.01); *H01Q 5/378* (2015.01); *H01Q 5/392* (2015.01)

(58) Field of Classification Search

CPC ..... H01Q 1/243; H01Q 9/42; H01Q 9/0414; H01Q 9/0421; H01Q 5/0062; H01Q 5/0068; H01Q 5/0048

USPC ..... 343/702

See application file for complete search history.

(56) References Cited

U.S. PATENT DOCUMENTS

| | | | | |
|---|---|---|---|---|
| 6,614,401 | B2 * | 9/2003 | Onaka et al. | 343/702 |
| 8,432,322 | B2 * | 4/2013 | Amm et al. | 343/702 |
| 8,593,351 | B2 * | 11/2013 | Hsieh et al. | 343/702 |
| 2005/0195124 | A1 * | 9/2005 | Puente Baliarda et al. | 343/893 |
| 2008/0055160 | A1 * | 3/2008 | Kim et al. | 343/700 MS |
| 2009/0135066 | A1 * | 5/2009 | Raappana et al. | 343/700 MS |
| 2010/0090921 | A1 | 4/2010 | Kim et al. | |
| 2012/0044114 | A1 | 2/2012 | Eom et al. | |
| 2012/0223865 | A1 * | 9/2012 | Li et al. | 343/702 |
| 2012/0313830 | A1 * | 12/2012 | Lee | 343/729 |

FOREIGN PATENT DOCUMENTS

| | | | |
|---|---|---|---|
| EP | 1 263 083 | A2 | 12/2002 |
| EP | 1 432 072 | A1 | 6/2004 |
| KR | 10-2009-0020419 | A | 2/2009 |
| KR | 10-2010-0097318 | A | 9/2010 |
| WO | 2004/114464 | A1 | 12/2004 |
| WO | 2007/042614 | A1 | 4/2007 |

* cited by examiner

*Primary Examiner* — Robert Karacsony

(74) *Attorney, Agent, or Firm* — Cha & Remer, LLC

(57) ABSTRACT

A built-in antenna apparatus of a mobile terminal includes a main board having at least one feeding portion for feeding RF power and at least one grounding portion at ground potential. The antenna apparatus includes first and second thin metal plates configured to be stacked on the main board and spaced from one another. The second metal plate is electrically connected to the feeding portion and has a length sufficient to resonate within a communication frequency band of the mobile terminal. The first metal plate is electrically connected to the grounding portion and electromagnetically coupled with the second metal plate to resonate.

19 Claims, 16 Drawing Sheets

1 : 880.000MHz 2.116
2 : 960.000MHz 2.269
3 : 1.710.000MHz 3.062
4 : 1.880.000MHz 1.786
5 : 1.990.000MHz 2.693
6 : 2.165.000MHz 6.179

<ANTENNA PERFORMANCE>

| Freq.[MHz] | Eff. (%) | Freq.[MHz] | Eff. (%) |
|---|---|---|---|
| 880 | 27 | 1805 | 35 |
| 896 | 32 | 1840 | 38 |
| 912 | 34 | 1880 | 38 |
| 928 | 40 | 1920 | 39 |
| 944 | 37 | 1950 | 43 |
| 960 | 33 | 1980 | 36 |
| 1710 | 20 | 2110 | 33 |
| 1745 | 30 | 2140 | 34 |
| 1785 | 32 | 2170 | 33 |

ANTENNA APPARATUS OF MOBILE TERMINAL

CLAIM OF PRIORITY

This application claims the benefit under 35 U.S.C. §119 (a) of a Korean patent application filed in the Korean Intellectual Property Office on Aug. 25, 2011 and assigned Serial No. 10-2011-0085046, the entire disclosure of which is hereby incorporated by reference.

BACKGROUND

1. Technical Field

This disclosure relates generally to an antenna apparatus of a mobile terminal, and more.

2. Description of the Related Art

As the telecommunication industry has rapidly advanced, mobile terminals such as cell phones, smart phones, personal digital assistants, etc. that perform wireless communication have become a necessity of modern society and an important means of transferring fast changing information.

As everybody knows, today's mobile terminals provide various multimedia functions and are increasingly miniaturized to enable convenient portability, fascinating users. Of the design challenges in these devices, the need to package many parts in a limited space of a miniaturized terminal remains difficult. One component requiring careful consideration is the antenna. In recent designs, antennas have been configured to mount inside the terminal to help realize a terminal that is elegant and small. It is important that such built-in antennas maintain good performance for the relevant communication service band. Generally, as an antenna is larger or positioned away from an interfering element, its performance improves. However, it is difficult to secure a mount space for an antenna in a limited space.

Furthermore, some new mobile terminal designs employ a metal member (for example, a metal frame) for an elegant appearance or reinforcement/support purpose. In the case where this metal member is positioned close to the built-in antenna, the antenna performance may deteriorate. With the trend towards increasing miniaturization, the problem is exacerbated. Thus it is difficult to secure sufficient distance between the built-in antenna and the metal member without degrading antenna performance.

Therefore, a built-in antenna with good antenna performance under this environmental circumstance of the terminal is desired.

SUMMARY

An aspect of the present invention is to address at least the above-mentioned problems and/or disadvantages and to provide at least the advantages described below. Accordingly, an aspect of the present invention is to provide an antenna apparatus of a mobile terminal, capable of achieving a desired antenna performance while being sized to fit within a slim, miniaturized mobile terminal.

Another aspect of the present invention is to provide an antenna apparatus of a mobile terminal, capable of avoiding deterioration of antenna performance by a metal member along the periphery of the terminal.

Still another aspect of the present invention is to provide an antenna apparatus of a mobile terminal, capable of transmitting/receiving a signal in multi-bands and a wideband.

In accordance with the present invention, a built-in antenna apparatus of a mobile terminal is provided, where the mobile terminal includes a main board having at least one feeding portion for feeding RF power and at least one grounding portion at ground potential. The antenna apparatus includes first and second thin metal plates configured to be stacked on the main board are spaced from one another. The second metal plate is electrically connected to the feeding portion and has a length sufficient to resonate within at least one communication frequency band of the mobile terminal. The first metal plate is electrically connected to the grounding portion and electromagnetically coupled with the second metal plate to resonate.

In some embodiments, resonance occurs in two or more frequency bands of the communication terminal.

The first and second metal plates may be separated by a dielectric material. The first metal plate may have a first portion in a region overlaying a first portion of the second metal plate with the same pattern (e.g., with parallel, meandering, or zig zag lines). The first or second metal plates may have a second portion extending away from the overlaying region. This second portion can be configured in a variety of ways, e.g., as a monopole, an open or closed loop, an open or closed slot, or an inverted F antenna.

Other aspects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings in which.

Throughout the drawings, like reference numerals will be understood to refer to like parts, components and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Exemplary embodiments of the present invention provide a built-in antenna apparatus of a mobile terminal. The exemplary antenna apparatus has a configuration that achieves suitable antenna performance for mobile terminal requirements while being amenable to easy packaging within a mobile terminal of a slim profile.

Figure 1:
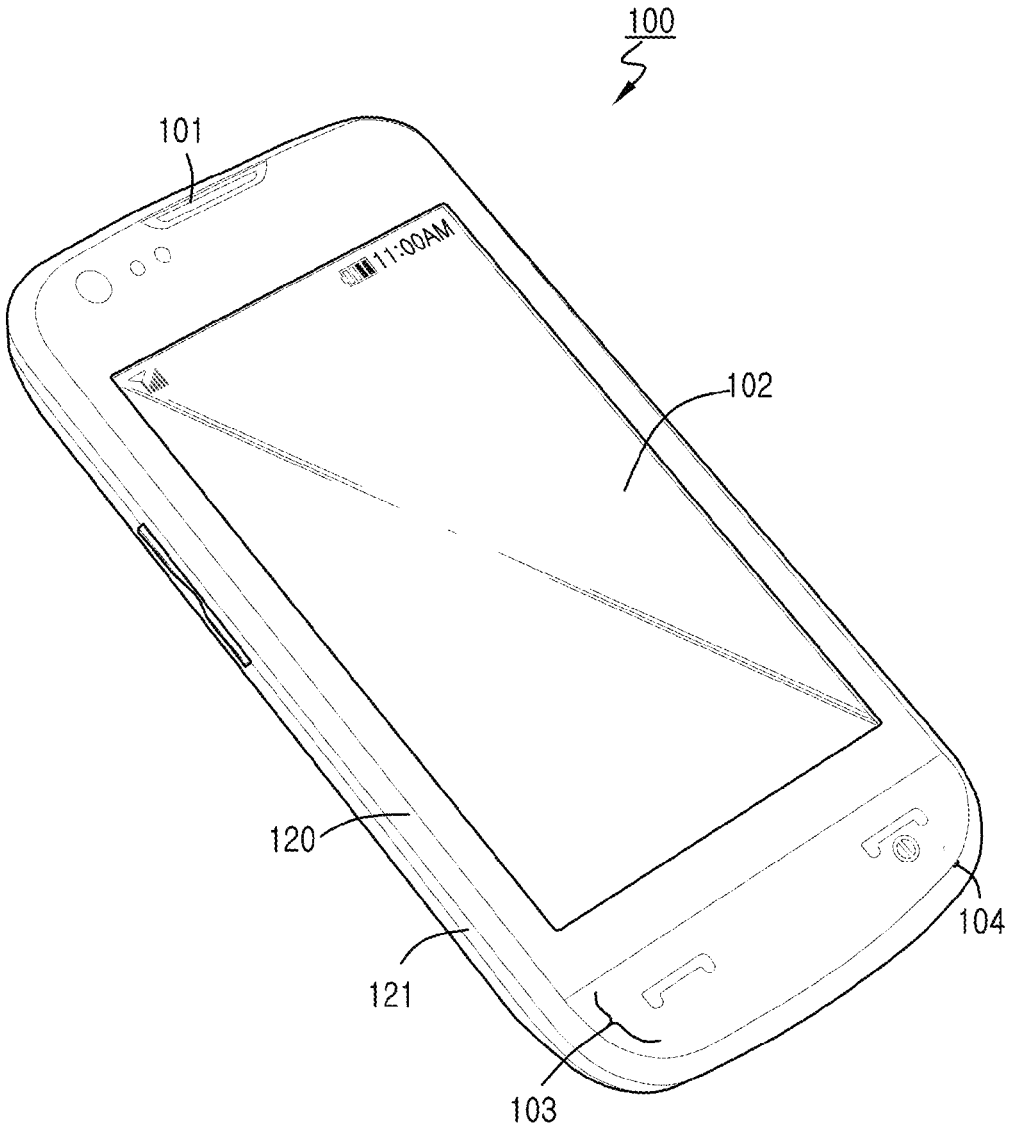
FIG. 1 is a perspective view illustrating a mobile terminal to which a built-in antenna apparatus has been applied according to an exemplary embodiment of the present invention.

FIG. 1 is a perspective view illustrating a mobile terminal, 100, to which a built-in antenna apparatus has been applied according to an exemplary embodiment of the present invention. Mobile terminal 100 includes a plurality of elements integrated with a body 120 to forma desired appearance. These may include a speaker 101 on a top portion for outputting audio; a centrally located display 102, e.g., a touch screen display, occupying the majority of the mobile terminal 100 front surface; a keypad assembly 103 serving as a data input unit; and a microphone 104 for inputting a voice signal. The display 102 may be a Liquid Crystal Display (LCD) having millions of pixels. If a touch screen is applied to the LCD, the display 102 may perform a function of a data input unit in substitution for the keypad assembly.

Furthermore, the exemplary mobile terminal 100 includes a metal frame 121 on the periphery of the body 120. The metal frame 121 may serve to both enhance aesthetics of the terminal elegant and also to reinforce rigidity. Frame 121 may be positioned on either the entire periphery of the body 120 or on only a portion of the body 120.

Metal frames such as frame 121 have been found to degrade performance of conventional built-in antennas. Accordingly, built-in antennas of the present disclosure are designed to achieve a desired antenna performance for mobile terminal communication despite the presence of the metal frame 121.

Figure 2:
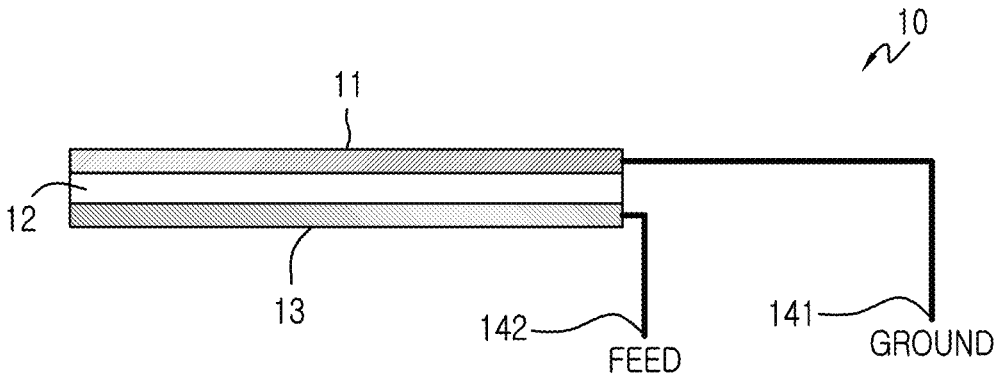
FIG. 2 is a schematic/side view illustrating a structure of a built-in antenna apparatus according to an exemplary embodiment of the present invention.

FIG. 2 is a schematic/side view illustrating a structure of a built-in antenna apparatus, 10, according to an exemplary embodiment of the present invention. As shown, the built-in antenna apparatus 10 includes a first conductor 11 electrically connected to ground by connecting to a grounding portion 141 of the mobile terminal 100. A second conductor 13 is electrically connected to a feed line (feeding portion) 142 of the mobile terminal 100, and is disposed in parallel with the first conductor 11. The second conductor 13 has a length sufficient to resonate within one of more frequency bands used by the mobile terminal 100. The first conductor 11 is electromagnetically coupled with the second conductor 13 to resonate. That is, the first conductor 11 is indirectly fed from the second conductor 13 to resonate. The built-in antenna apparatus 10 has a harmonic resonance characteristic of the first conductor 11 and the second conductor 13.

Feed line 142 and ground portion 141 are connection points of a transmission line interfacing with antenna 10. For example, antenna 10 may connect to an RF communication unit (not shown) of the mobile terminal 100 that transmits output RF power over the transmission line between feed line 142 and ground portion 141. During receive operations, antenna 10 supplies receive signal power to the transmission line between points 141 and 142. The transmission line may be e.g., microstrip, in which the feed line 142 is an end portion of the conducting strip and ground portion 141 is a connection to the ground plane of the microstrip. When mobile terminal 100 is transmitting, RF energy flows from the RF communication unit in the space between feed line 142 and ground portion 141 to antenna 10, which induces currents along the metal plates 11, 13 that cause the desired radiation of the RF energy.

The first conductor 11 and the second conductor 13 are oriented to run in parallel, with a dielectric 12 interposed between them whereby they do not contact each other physically. The dielectric 12 separates the first conductor 11 from the second conductor 13. Instead of dielectric, a magnetic material may be used. The dielectric material need not run along the entire length of the first conductor 11 and the second conductor 13. Instead, dielectric may be placed on only a portion of the space between the first conductor 11 and the second conductor 13 regularly or irregularly.

In addition, the first conductor 11 and the second conductor 13 need not have the same length. Each has a length and a width suitable for a resonance characteristic of a relevant communication service band.

The first and second conductors 11 and 13 may each be embodied as a metal thin plate or conducting strip in order to present a small volume on the whole. According to an exemplary embodiment of the present invention, both the first conductor 11 and the second conductor 13 may be thin metal plates or strips or only one of them may be a thin metal plate or strip.

As will become apparent in the various embodiments to be described, the first and second conductors 11, 13 can be designed to have various shapes in accordance with embodiments of the invention. These include straight lines, meandering lines, zig zags, and so forth.

Antenna apparatus 10 will be referred to herein as a "rail antenna", due to its rail-like structure, as is apparent in the drawings, particularly in cross section. Thus, a rail antenna, as the term is used herein refers generally to two elongated conductors running in parallel and spaced apart by a uniform distance.

Reference herein to "ground" refers a point of reference potential within the mobile terminal, and does not refer necessarily to "earth ground". Neither the mobile terminal nor the built-in antennas of the present embodiments need to be grounded to earth at any point thereof in order to operate.

Figure 3:
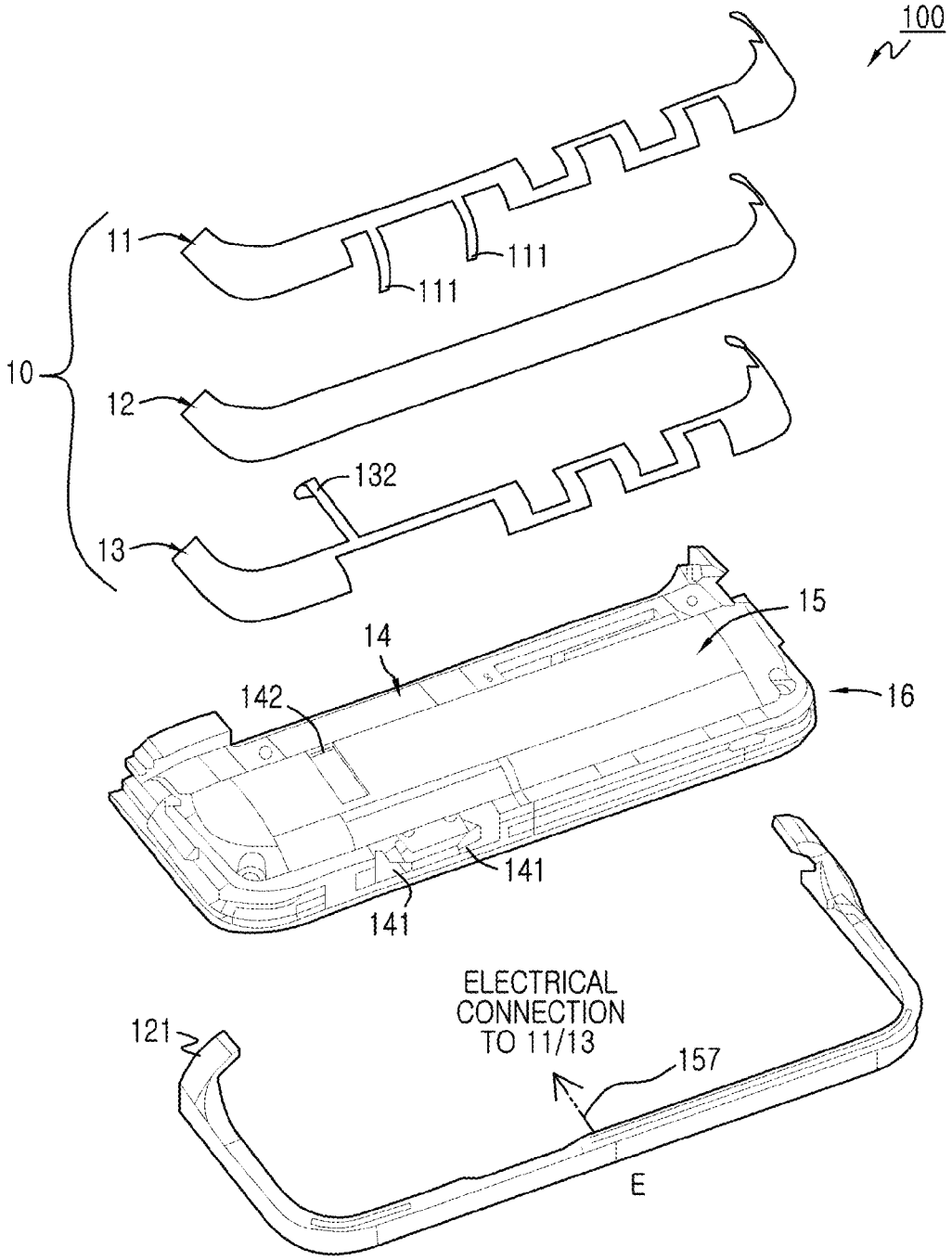
FIG. 3 is an exploded perspective view of a built-in antenna apparatus and mobile terminal according to an exemplary embodiment of the present invention.
Figure 4:
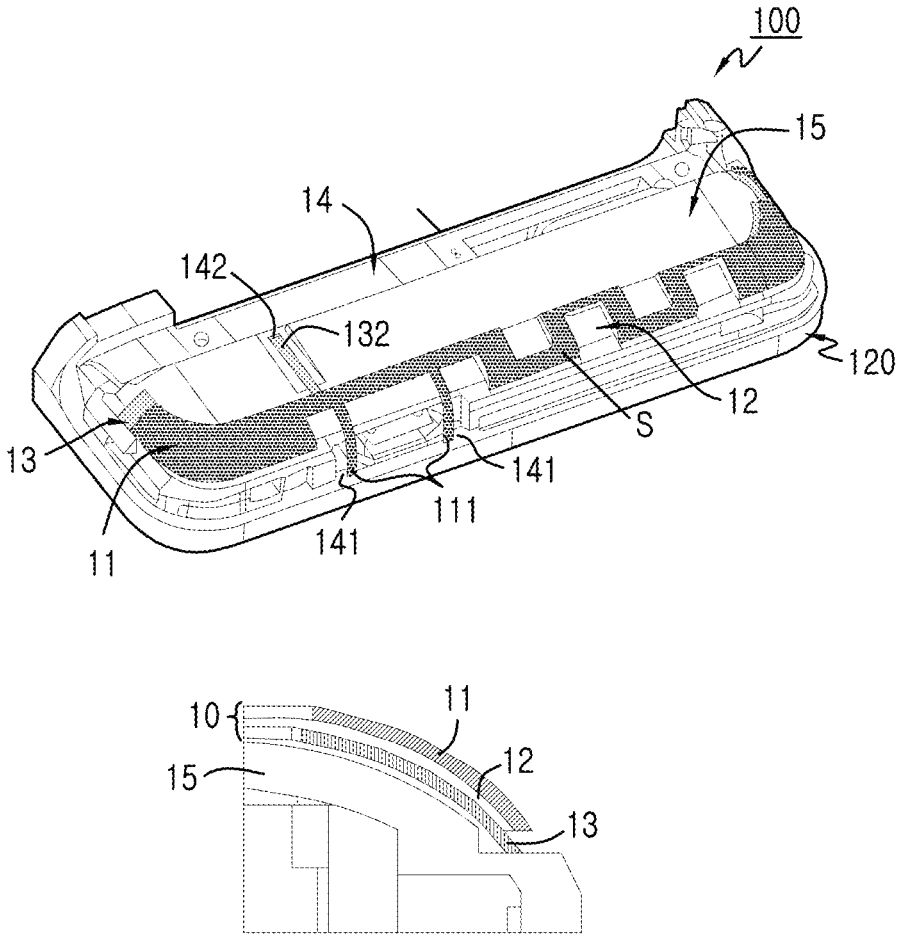
FIG. 4 shows perspective and side views of an exemplary built-in antenna apparatus assembled in a mobile terminal.

FIG. 3 is an exploded perspective view of a built-in antenna apparatus and mobile terminal according to an exemplary embodiment of the present invention. FIG. 4 shows perspective and side views of the same built-in antenna apparatus assembled to the mobile terminal.

Referring to FIGS. 3 and 4, the built-in antenna apparatus 10 is configured to be stacked on a main printed circuit board 14 of mobile terminal 100. A grounding portion 141 and a feeding portion 142 are formed on mobile terminal 100, which connect to first conductor 11 and second conductor 13, respectively. (First and second conductors 11 and 13 will be referred to interchangeably as first and second thin metal plates, respectively.) An injection molding material (referred to as a carrier 15 hereinafter) is fixed in the main board 14. Antenna apparatus 10 comprising first and second conductors 11 and 13 with a dielectric 12 disposed in between, are located on a carrier 15.

The first metal plate 11 and the second metal plate 13 do not contact each other physically with the dielectric 12 interposed. The dielectric 12 separates the first metal plate 11 from the second metal plate 13. A magnetic material may replace the dielectric 12. The dielectric material need not run along the entire lengths of the first and second conductors 11 and 13, as mentioned above. As depicted in FIG. 3, the antenna apparatus 10 is assembled to a component assembly 16 of mobile terminal 100 including the main board 14.

The first metal plate 11 is formed with at least one grounding terminal 111 extending therefrom. In the illustrated embodiment, two grounding terminals 111 are used, which extend perpendicularly as strips from the main orientation of metal plate 11. The grounding terminal(s) 111 is electrically connected with the grounding portion 141 of the main board 14. Furthermore, the second metal thin plate 13 is formed with a feeding terminal 132, which is electrically connected with the feeding portion 142 of the main board 14. The first metal thin plate 11 and the second metal thin plate 13 each have a major axis that is disposed in parallel with each other, and lengthwise with mobile terminal.

The first and second metal plates can be embodied with substantially the same patterns in at least one portion or along the entire geometry. The patterns include meandering portions S in the exemplary embodiment, to achieve a desired overall electrical length and design the antenna 10 for resonance at one or more specific resonant frequencies. In the embodiment of FIGS. 3 and 4, metal plates 11 and 13 have substantially the same patterns along their entire lengths, with the exception of the terminal designs 111 and 132, and a slightly longer length for metal plate 13. In relation to the main board 14, metal plate 11 overlays the second metal plate 13.

The second metal plate 13 is fed from the feeding portion 142, and is designed to resonate at frequencies within one or more communication frequency bands of mobile terminal 100. Design parameters for metal plate 13 to achieve resonance at one or more desired frequencies include its total length (including the length of any meandering or zig zag portions S), and its geometry in relation to the feed point locations. The first metal thin plate 11 is electromagnetically coupled with the second metal plate 13 to resonate. That is, the first metal plate 11 is indirectly fed from the second metal thin plate 13 to resonate.

If necessary or desired, the first metal plate 11 is formed with a plurality of grounding terminals 111 and the grounding terminals are electrically connected with a plurality of grounding portions 141 of the main board 14, so that the first metal plate 11 may be grounded at a plurality of positions. Likewise, the second metal plate 13 can be formed with a plurality of feeding terminals and these feeding terminals are electrically connected with the feeding portion 142 of the main board 14, so that the second metal plate 13 may be fed at a plurality of positions.

As illustrated, in relation to the main board 14 in the bottom position, the second metal plate 13 faces main board 14, and the first metal plate 11 overlays the second metal plate 13. However, the configuration is not limited thereto. That is, an alternative arrangement is for first metal plate 11 to face main board 14 and for the second metal plate 13 to overlay the first metal plate 11. The first metal thin plate 11 and the second metal plate 13 have a patterned shape for providing a relevant resonance characteristic. Particularly, the first metal plate 11 generally conforms to the shape of the second metal plate 13 in order to be indirectly and instantly fed from the second metal plate 13.

As mentioned above, the mobile terminal 100 may include a metal frame 121 for aesthetics and/or reinforcing rigidity. The metal frame 121 can be electrically connected with the first metal thin plate 11 or the second metal thin plate 13 to serve as an additional antenna element. The first metal plate 11 or the second metal plate 13 may be formed with at least one terminal electrically connected with the metal frame 121, as schematically illustrated by coupling line 157.

Consequently, an antenna apparatus 10 embodied as a "rail antenna" apparatus according to the present invention may reduce an influence of a neighboring metal (for example, a metal frame) due to a large capacitance between the first and second metal plates 11 and 13, whereby a required antenna performance for the mobile terminal applications is attainable. A desired antenna performance is achievable for a variety of shapes of the first metal plate 11 and the second metal thin plate 13, which may be independent of the metal frame 121 shape.

Figure 5:
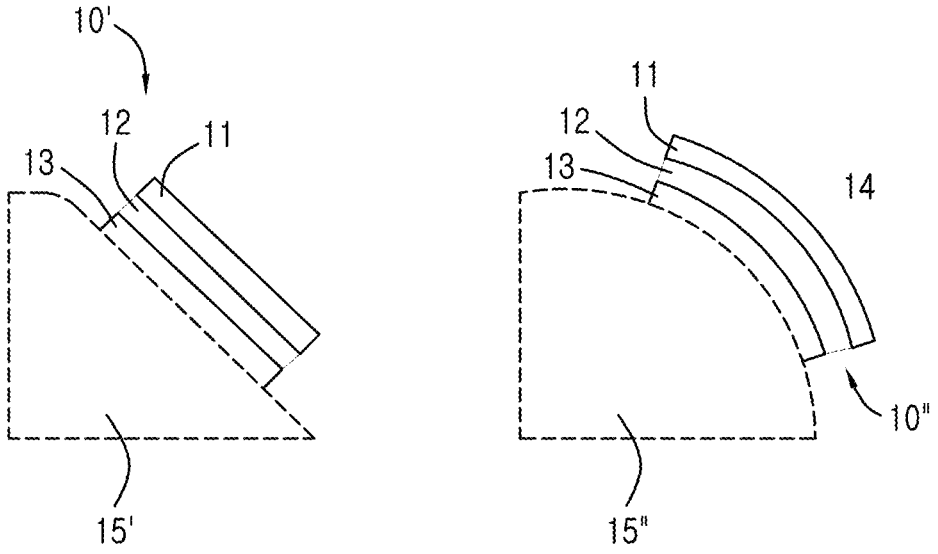
FIG. 5 depicts side views illustrating various shapes of a built-in antenna apparatus according to exemplary embodiment(s) of the present invention.

FIG. 5 depicts side views illustrating various shapes of a built-in antenna apparatus according to an exemplary embodiment(s) of the present invention. As shown, the first and second metal plates 11 and 13 conform to the shape of the carrier 15 in various embodiments. For example, when the carrier 15' has a flat surface for mounting/attaching antenna apparatus 10', metal plates 11 and 13, which can be flexible, conform to the flat surface. When carrier 15" is provided with a curved attachment surface, the metal plates 11 and 13 conform to the curved shape (as shown for antenna apparatus 10").

Figure 6A:
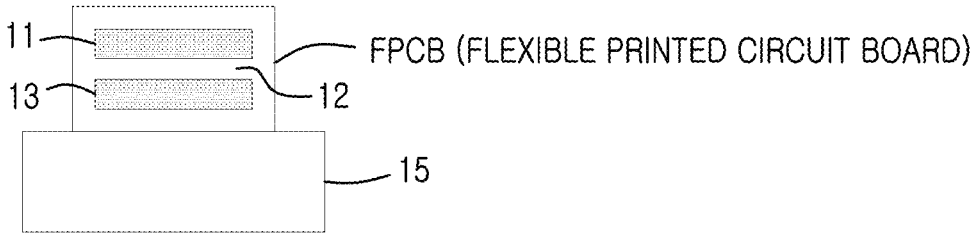
FIGS. 6A and 6B are end views illustrating different construction configurations of an exemplary built-in antenna apparatus.
Figure 6B:
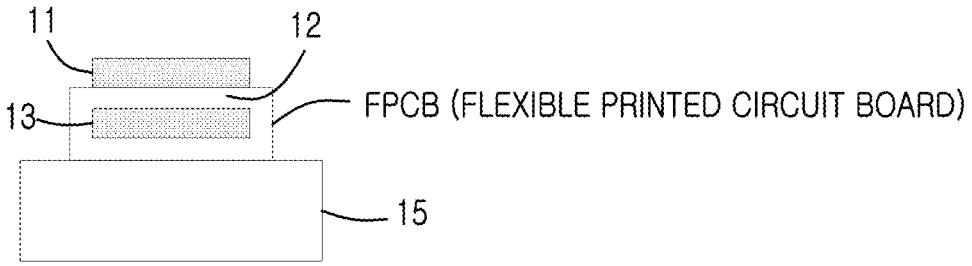

FIGS. 6A and 6B are end views illustrating different construction configurations of an exemplary built-in antenna apparatus.

In the configurations of FIGS. 6A and 6B, the first and second metal plates 11 and 13 can be formed integrated with dielectric 12 by controlled insertion into the dielectric 12 while the dielectric 12 is molded. In FIG. 6A, the first metal plate 11 and the second metal plate 13 can be formed of a Flexible Printed Circuit Board (FPCB) such that a separate dielectric is not required (the dielectric material 12 is part of the FPCB). Note that the first metal plate 11 and the second metal plate 13 may be formed in a single FPCB. Furthermore, in the embodiment of FIG. 6B, only one of the first metal plate 11 and the second metal plate 13 is formed as part of an FPCB, while the other is arranged on a surface of the FPCB.

Figure 7A:
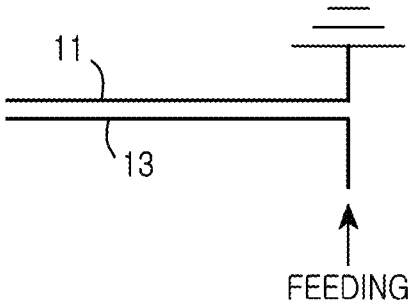
FIGS. 7A to 7E schematically illustrate various ground structures and feeding structures of exemplary built-in antenna apparatus.
Figure 7B:
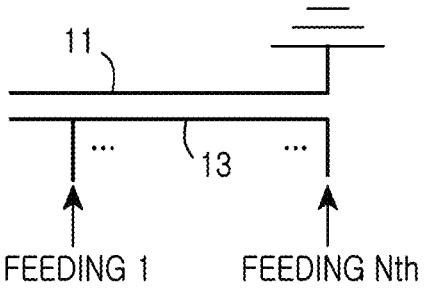
Figure 7C:
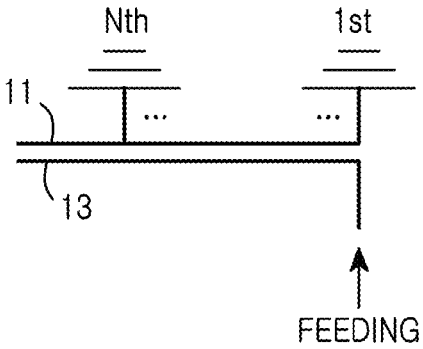
Figure 7D:
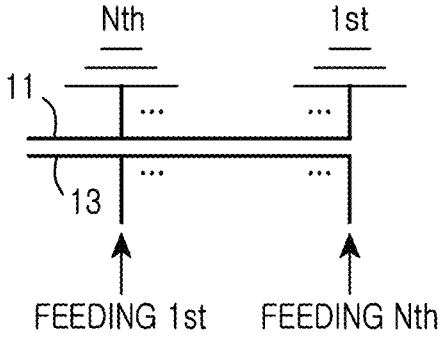
Figure 7E:
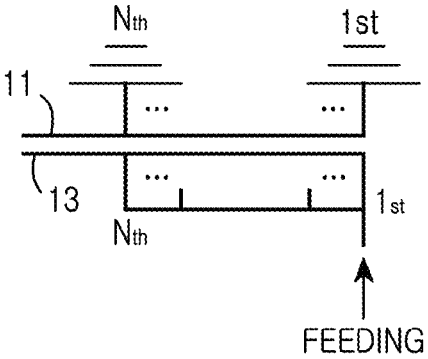
Figure 12:
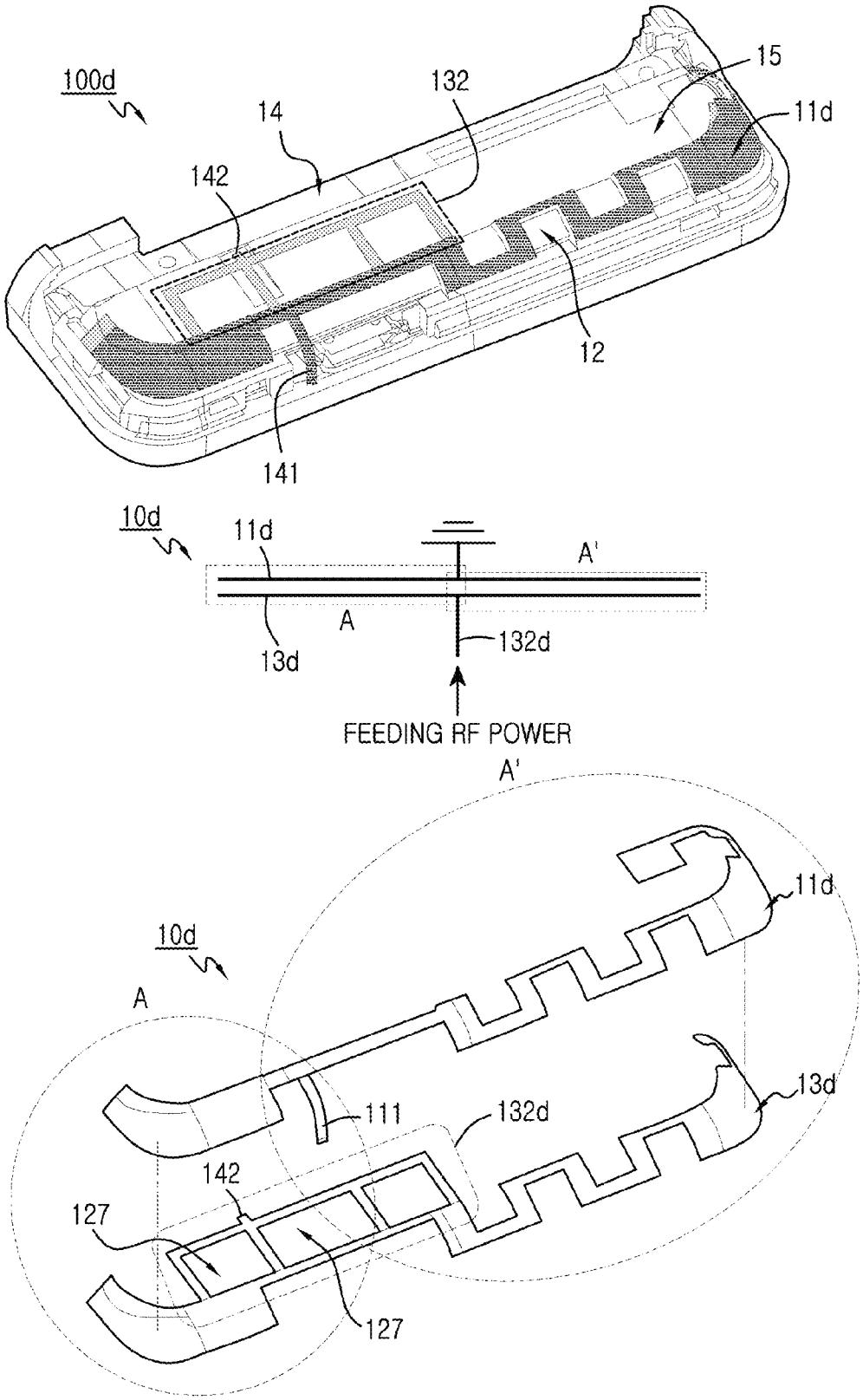
FIG. 12 shows perspective and schematic views illustrating another type of a built-in antenna apparatus according to an exemplary embodiment of the present invention.

FIGS. 7A to 7E schematically illustrate various ground structures and feeding structures of built-in antenna apparatus according to exemplary embodiments of the present invention. In FIG. 7A, the first metal plate 11 has a single grounding terminal, and the second metal plate 13 has a single feeding terminal. In FIG. 7B, the first metal plate 11 has a single grounding terminal, and the second metal thin plate 13 has a plurality of spaced apart feeding terminals. In FIG. 7C, the first metal plate 11 has a plurality of grounding terminals, and the second metal plate 13 has a single feeding terminal. In FIG. 7D, the first metal plate 11 has a plurality of spaced apart grounding terminals, and the second metal plate 13 has a plurality of spaced apart feeding terminals. In FIG. 7E, the first metal plate 11 has a plurality of grounding terminals, and the second metal plate 13 has a branched-type feeding terminal. The main board 14 a corresponding grounding portion and feeding portion depending on the number and positions of the grounding terminals and feeding terminals. For example, the second metal plate 13 of the built-in antenna apparatus 10 illustrated in FIG. 12 shows a configuration of one branched feeding terminal 132.

Figure 8:
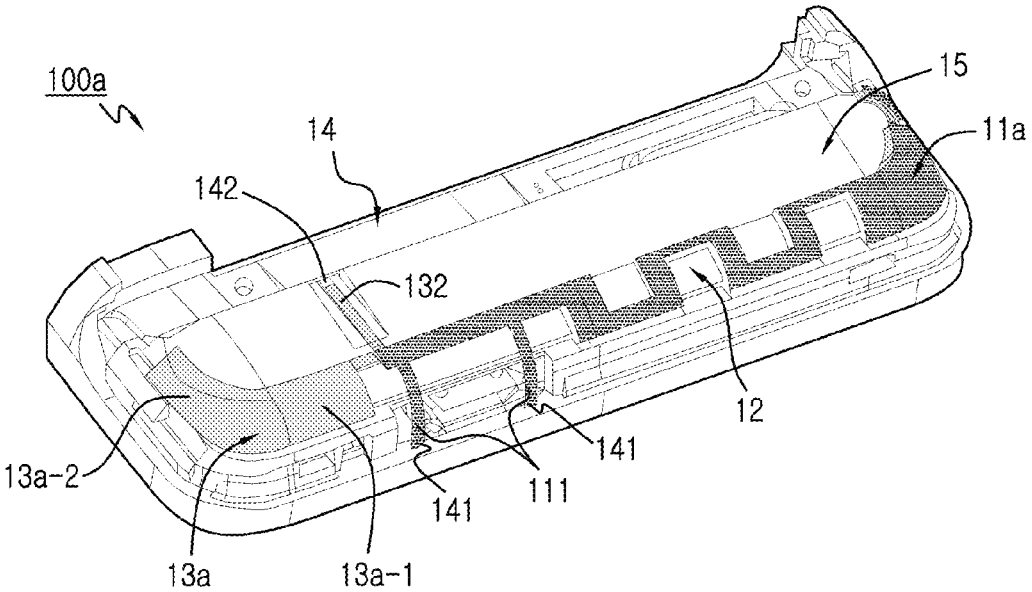
FIG. 8 shows perspective and schematic views illustrating a partial rail antenna, partial monopole type built-in antenna apparatus according to an exemplary embodiment of the present invention.
Figure 8:
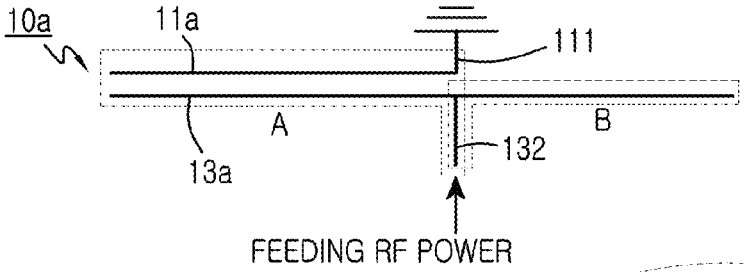
Figure 8:
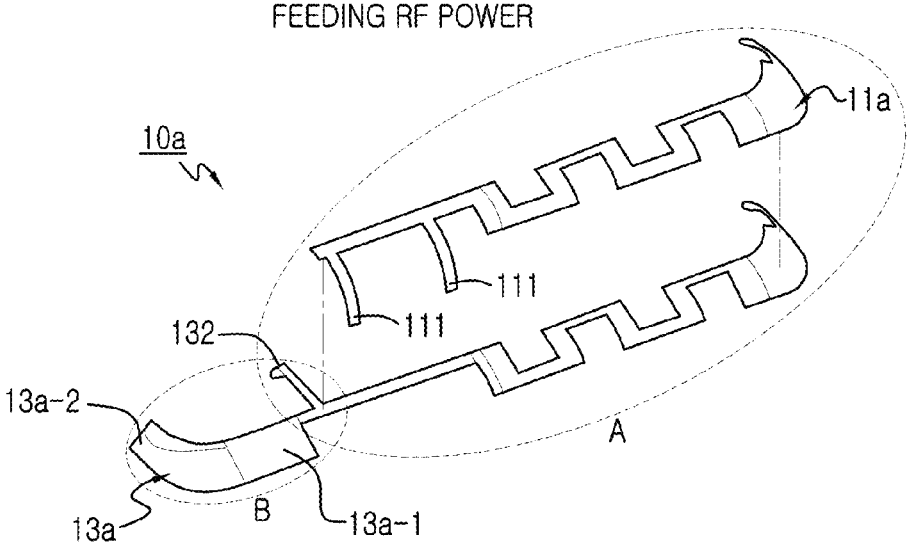

FIG. 8 shows perspective and schematic views illustrating a partial rail antenna, partial monopole type built-in antenna apparatus, 10*a*, according to an exemplary embodiment of the present invention. The upper view shows antenna apparatus 10*a* assembled within a mobile terminal 100*a*; the central view is a schematic illustration; and the lower view is an exploded perspective view of antenna 10*a* without showing dielectric in between for clarity.

In general, the first metal plate includes a first portion in a region (A) overlaying a first portion of the second metal plate with the same pattern, and the first or second metal plates has a second, extending portion (B) extending away from the overlaying region. (In the embodiment of FIG. 8, the second metal plate 13*a* has the extending portion B; in the embodiment of FIG. 9, first metal plate 11*a*' has the extending portion B.)

Referring still to FIG. 8, the built-in antenna apparatus 10*a* has a construction where a rail antenna type A portion and a monopole antenna type B portion harmonize. The second metal plate 13*a* is formed with a portion 13*a*-1 disposed in parallel with the lengthwise axis of first metal plate 11 and a portion 13*a*-2 oriented non-parallel to the axis. That is, in this embodiment, the monopole portion B has a straight portion 13*a*-1 generally parallel to the rail antenna portion A, and a curved portion 13*a*-2 that is non-parallel.

The portions of the first and second metal plate 11*a* and 13*a* that overlay one another, i.e., those portions in region A, resonate in a rail antenna type A. Furthermore, the extension portion of the second metal plate 13 resonates in a monopole antenna type B. Consequently, the built-in antenna apparatus 10 has a resonance characteristic where the rail antenna type A (interchangeably called "region A") and the monopole antenna type B harmonize.

Figure 9:
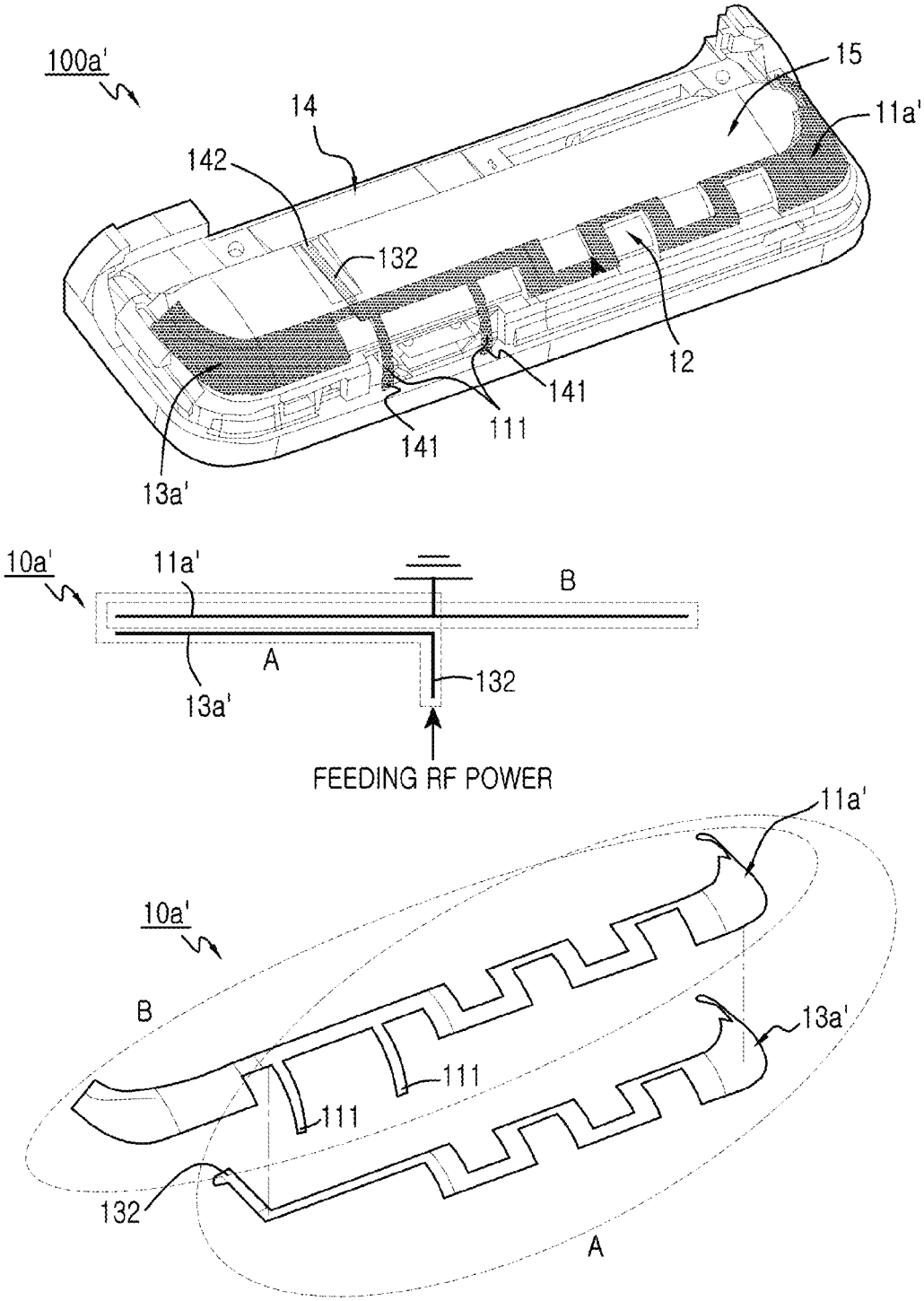
FIG. 9 shows perspective and schematic views illustrating a partial rail antenna, partial inverted-F type built-in antenna apparatus according to an exemplary embodiment of the present invention.

FIG. 9 shows perspective and schematic views illustrating a partial rail, partial inverted-F type of a built-in antenna apparatus according to an exemplary embodiment of the present invention. As shown, the built-in antenna apparatus 10*a*' is similar to antenna apparatus 10*a* of FIG. 8 in that one of the two conductors (thin metal plates) has a portion B extending away from a region A in which one plate overlays the other in a substantially identical pattern. With antenna 10*a*' of FIG. 9, the first metal plate 11*a*' has the portion B extending away from region A.

Antenna apparatus 10*a*' is formed in a configuration where a rail antenna type A and an inverted F antenna type or a flat plate inverted F antenna (PIFA) type B harmonize. The first metal plate 11*a*' is formed with a portion running in parallel with the second metal plate 13 and a portion running non-parallel to the second metal plate 13. (Note that the end portion of region B is oriented perpendicular to the main axis of first conductor 11*a*' as seen in the perspective views; for simplicity in the following discussion, the entire region B is said to constitute an F-antenna type that runs non-parallel to region A.) The portion of the first metal plate 11*a*' running parallel with the second metal plate 13, and the second metal plate 13 resonate in a rail antenna type A (interchangeably called "region A"). Furthermore, the portion of the first metal plate 11*a*' running non-parallel with the second metal plate 13 resonates in the inverted F antenna type indirectly fed from the second metal plate 13*a* or the flat plate inverted F antenna type B. Consequently, the built-in antenna apparatus 10 has a resonance characteristic where the rail antenna type A and the inverted F antenna type B harmonize.

Antenna apparatus 10*a*' is shown assembled in mobile terminal 100*a*' in the upper region view of FIG. 9.

Figure 10:
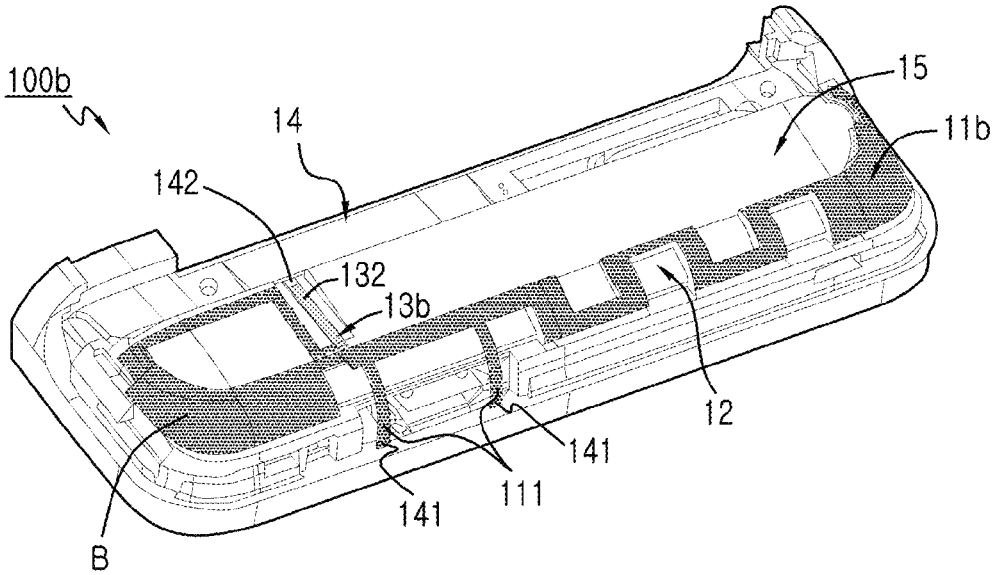
FIG. 10 shows perspective and schematic views illustrating a partial rail antenna, partial loop antenna type of a built-in antenna apparatus according to an exemplary embodiment of the present invention.
Figure 10:
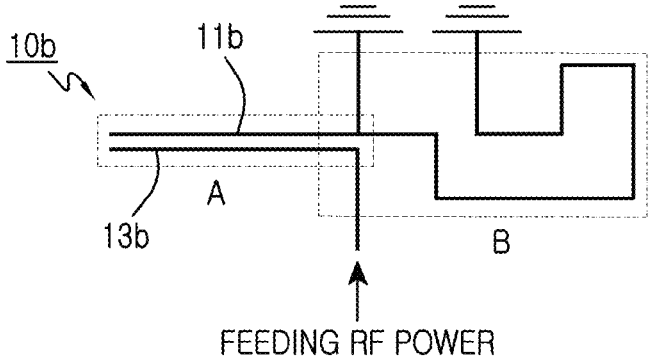
Figure 10:
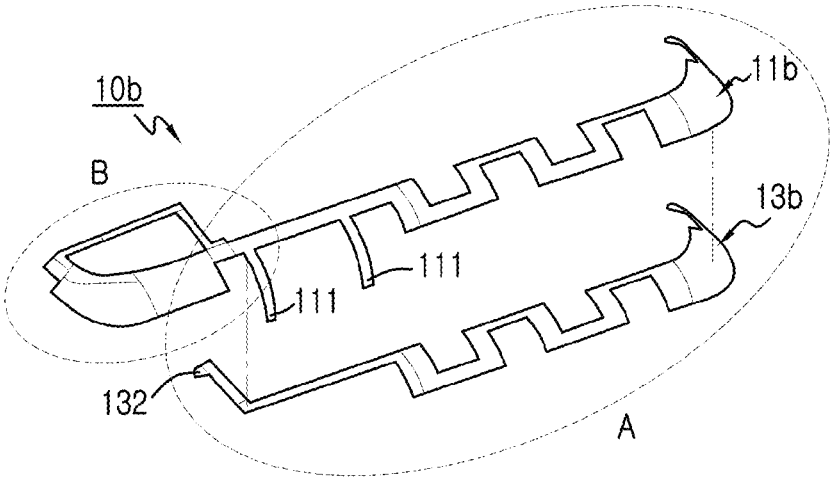

FIG. 10 shows perspective and schematic views illustrating a partial rail antenna, partial loop antenna type of a built-in antenna apparatus, 10*b*, according to an exemplary embodiment of the present invention. As shown, antenna apparatus 10*b* has a configuration where a rail antenna type A and a loop antenna type B harmonize. The first metal plate 11*b* is formed with a portion running in parallel with the second metal thin plate 13*b* (plate 11*b* overlays plate 13*b* with substantially the same pattern), to resonate in the rail antenna type A. An extended portion of metal plate 11*b* has a loop shape, sections of which are disposed non-parallel with the second metal plate 13*b*.

The portion of plate 11*b* having the loop shape resonates in a loop antenna type B having a structure indirectly fed from the second metal plate 13*b* and grounded. The loop shape may have a closed loop shape, as depicted in the lower region perspective view, or an open loop shape, as shown in the central region schematic view. In the example open loop embodiment, the end portion of the open loop is coupled to ground to define a second grounding point.

In both the open and closed loop configurations, the built-in antenna apparatus 10*b* has a resonance characteristic where the rail antenna type A and the loop antenna type B harmonize. Antenna apparatus 10*b* is shown assembled to mobile terminal 100*b* in the upper region perspective view.

Figure 11:
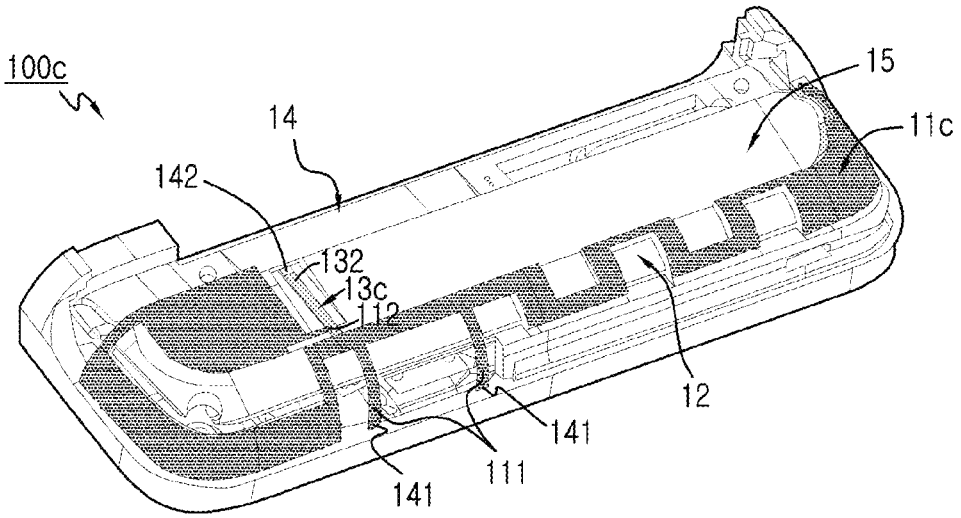
FIG. 11 shows perspective and schematic views illustrating a partial rail antenna, partial slot antenna type of a built-in antenna apparatus according to an exemplary embodiment of the present invention.
Figure 11:
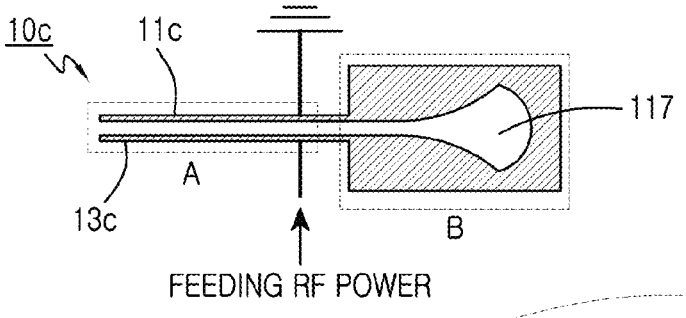
Figure 11:
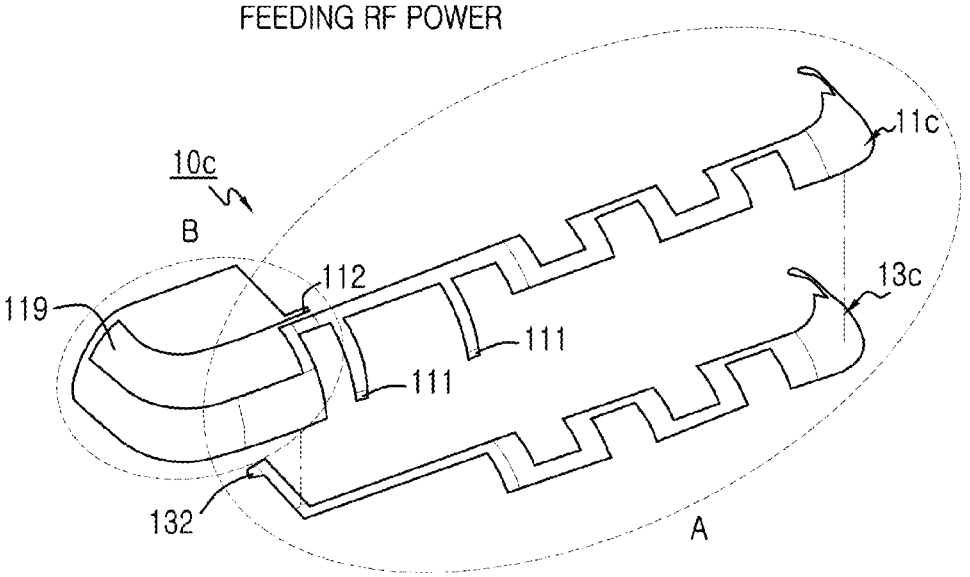

FIG. 11 shows perspective and schematic views illustrating a partial rail antenna, partial slot antenna type of a built-in antenna apparatus, 10*c*, according to an exemplary embodiment of the present invention. Antenna apparatus 10*c* has a construction where a rail antenna type A and a slot antenna type B harmonize. The rail antenna type A can be the same as described above in FIGS. 8-10. That is, the first metal plate 11*c* has a portion, in region A, geometrically matching the second metal plate 13*c*.

In region B, a slot-shaped portion extends from metal plate 11*c*. As depicted in the lower region perspective view, the slot shaped portion can have an open slot configuration to form an open slot 119. Alternatively, the slot shaped portion can form a closed slot 117 as depicted in the centralized schematic view. In both cases, as seen in FIG. 11, the slot portion B can be formed with metallization substantially wider than in the rail antenna portion A. In the closed slot configuration, the metal pattern surrounding the slot connects on opposite sides to the thinner metal plates 11*c* and 13*c*.

Thus the slot-shaped portion of the first metal plate 11*c* resonates in a slot antenna type B having a structure that is also connected to the second metal plate 13.

A connection strip 112 may be formed on an end portion of the slot shaped portion B. If the connection strip 112 is connected with a feeding terminal 132 of the second metal plate 13*c*, a closed loop configuration is formed. Accordingly, the slot may be indirectly or directly fed from the second metal plate 13*c* to resonate. Consequently, the built-in antenna apparatus 10*c* has a resonance characteristic where the rail antenna type A and the slot antenna type B harmonize. Antenna apparatus 10*c* is shown assembled within mobile terminal 100*c* in the upper region view.

FIG. 12 shows perspective and schematic views illustrating another type of a built-in antenna apparatus, 10*d*, according to an exemplary embodiment of the present invention. The second metal plate 13*d* of the built-in antenna apparatus 10*d* forms a branched type feeding terminal 132*d*, which effectively forms a plurality of windows 127. The "frames" of the respective windows electrically connect to the second metal plate 13*d*. The second metal plate 13*d* is thus effectively fed at a plurality of positions from the single feeding portion 142 of the main board 14. Furthermore, the second metal plate 13*d* extends on both sides in significant lengths from the central branch of feeding terminal 132*d*. The first metal plate 11*d* has a shape substantially conforming to that of the second metal plate 13*d*. Consequently, the built-in antenna apparatus 10*d* has a resonance characteristic where two rail antenna types A and A' harmonize. Antenna apparatus 10*d* is shown assembled to a mobile terminal 100*d* in the upper region view.

Figure 13:
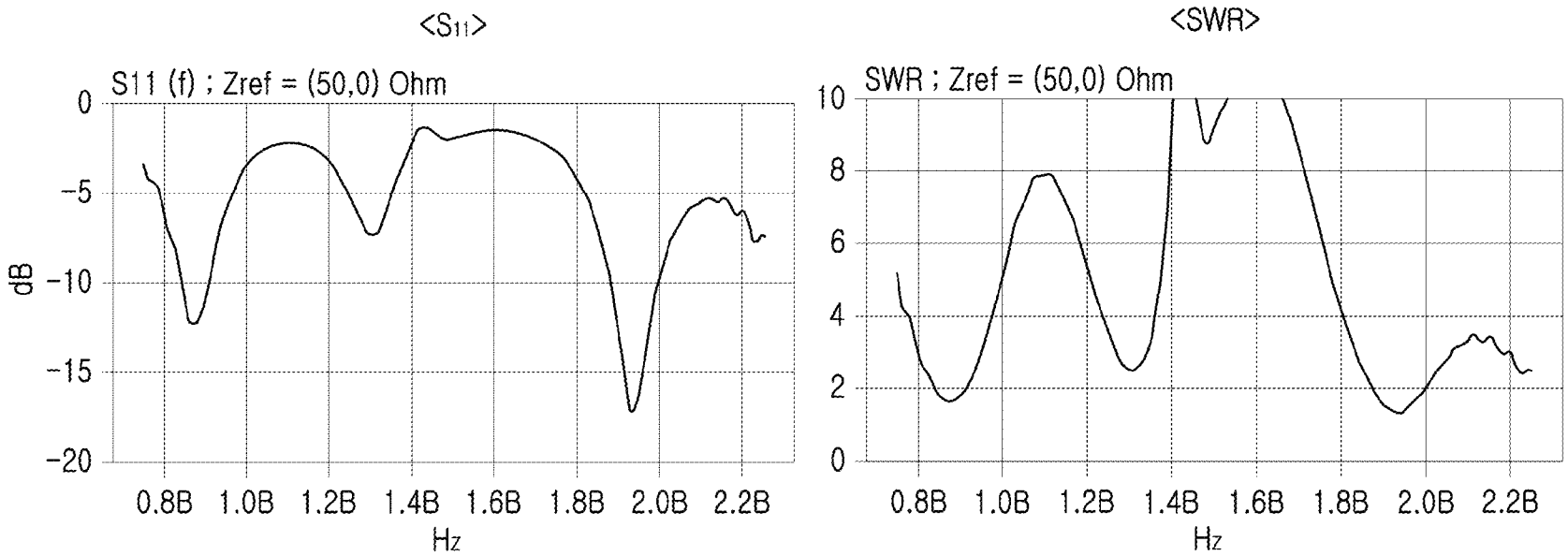
FIG. 13 is a graph illustrating a resonance characteristic of the built-in antenna apparatus of FIG. 12.
Figure 14:
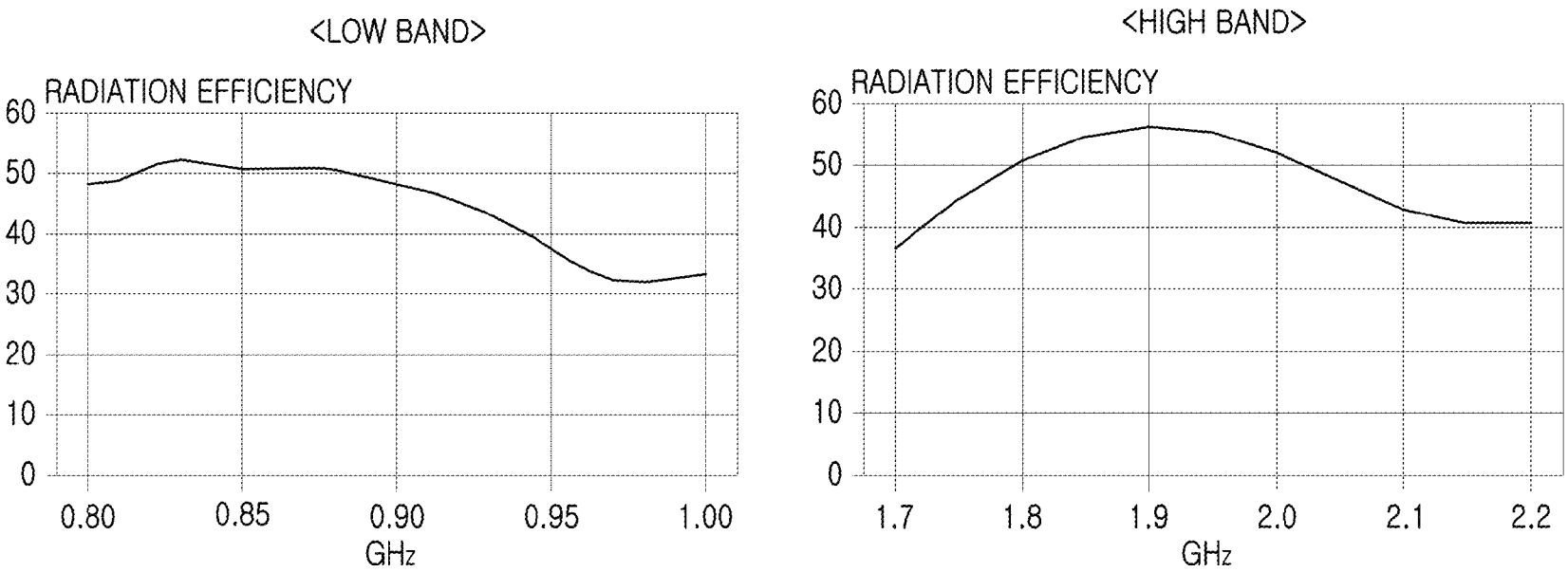
FIG. 14 is a graph illustrating an antenna performance of the built-in antenna apparatus of FIG. 12.

FIG. 13 is a graph illustrating a resonance characteristic of an example built-in antenna apparatus 10*d* of FIG. 12, and FIG. 14 is a graph illustrating an antenna performance of the example built-in antenna apparatus of FIG. 12.

Referring to FIG. 13, the built-in antenna apparatus 10*d* exhibits a resonance characteristic at multiple bands. Thus the antenna is particularly suitable at least for those frequency bands centered around the resonant frequencies. In addition, depending on mobile terminal requirements, a particular design for antenna 10*d* may be suitable for a wideband operation, i.e., from a low frequency band to a high frequency band, when considering a criteria of return loss corresponding to approximately −6 dB or better and an acceptable Standing Wave Ratio (SWR).

Referring to FIG. 14, considering radiation efficiency, the built-in antenna apparatus has a good antenna performance of 30% or higher on the whole in a low frequency band, and good antenna performance of 40% or higher on the whole in a high frequency band.

Figure 15:
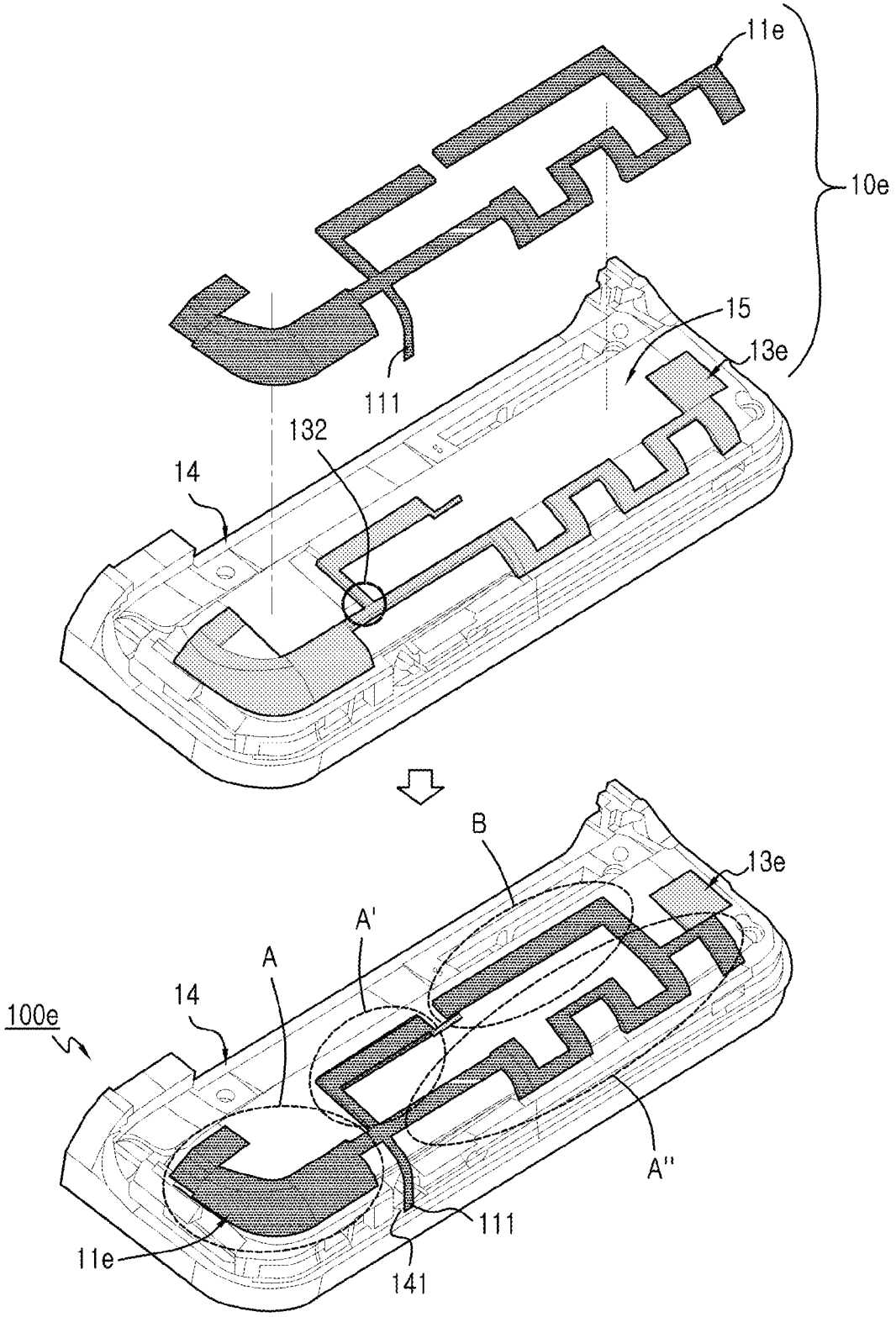
FIG. 15 is a perspective view illustrating a type of a built-in antenna apparatus according to an exemplary embodiment of the present invention.

FIG. 15 is a perspective view illustrating another type of built-in antenna apparatus 10*e* according to an exemplary embodiment of the present invention. The second metal plate 13*e* of the built-in antenna apparatus 10*e* is extends in significant length in three branches from the feeding terminal 132. The first metal plate 11*e* has a shape substantially conforming to the second metal thin plate 13*e*. Furthermore, the first metal plate 11*e* has a portion running non-parallel to the second metal plate 13*a*. Consequently, the built-in antenna apparatus 10*e* has a resonance characteristic where three rail-type antennas A, A', and A", and one IFA type or PIFA type antenna (denoted as B) harmonize.

Figure 16:
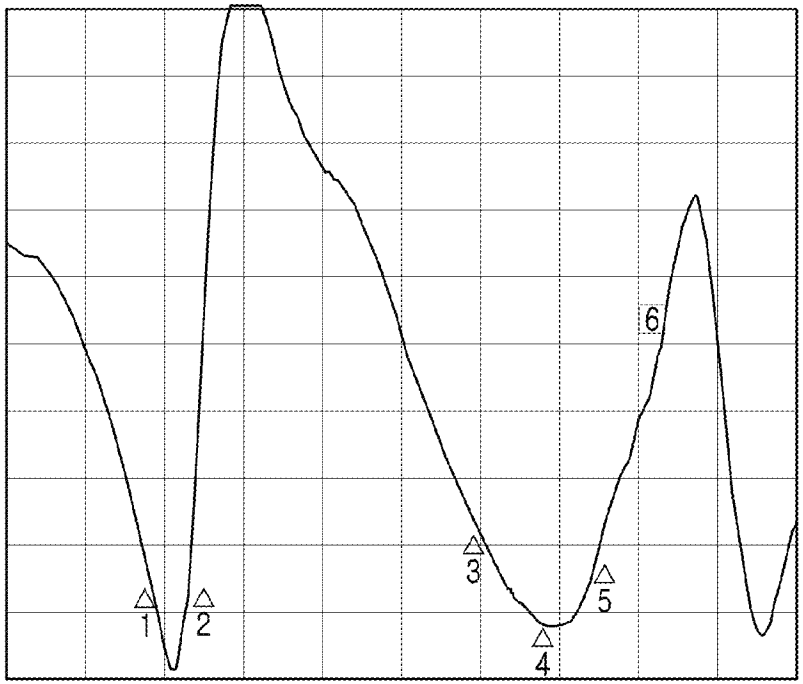
FIG. 16 is a graph illustrating a resonance characteristic of the built-in antenna apparatus of FIG. 15.

FIG. 16 is a view illustrating a resonance characteristic of the built-in antenna apparatus of FIG. 15.

Referring to FIG. 16, the built-in antenna apparatus has a good antenna performance of 30% or higher on the whole over a range extending from a low frequency band to a high frequency band.

The above-described built-in antenna apparatus according to the exemplary embodiments of the present invention has a structure where two metal thin metal plates do not contact each other physically, and which are stacked on a carrier. However, the number of stacked metal plates are not limited to two. That is, in further embodiments, three or more thin metal plates may be electrically connected to the grounding portion 141 or the feeding portion 142 of the main board 14 to form an antenna element.

Consequently, an antenna apparatus assembled within a mobile terminal according to the present invention may achieve a desired antenna performance and simultaneously help to realize a mobile terminal having a slim profile.

Although the invention has been shown and described with reference to certain exemplary embodiments thereof, it will be understood by those skilled in the art that various changes in form and details may be made therein without departing from the spirit and scope of the invention as defined by the appended claims and their equivalents. Therefore, the scope of the present invention should not be limited to the above-described embodiments but should be determined by not only the appended claims but also the equivalents thereof.

What is claimed is:

1. A built-in antenna apparatus of a mobile terminal, the mobile terminal including a main board having at least one feeding portion for feeding RF power and a plurality of grounding portions at ground potential, the antenna apparatus comprising:

a first metal plate and a second metal plate configured to be stacked on the main board and spaced from each other, wherein the second metal plate is electrically connected to the feeding portion and has a length sufficient to resonate in which the first metal plate and the second metal plate have a resonance characteristic for operation together where two rails harmonize, the two rails comprising one elongated conductor of the first metal plate and one elongated conductor from the second metal plate extending in parallel, and the first metal plate is electrically connected to the plurality of grounding portions and electromagnetically coupled with the second metal plate to resonate, a plurality of grounding terminals that extend from the first metal plate to be in contact with a respective grounding portion of the plurality of grounding portions, wherein each of the first metal plate and the second metal plate has a respective first portion, in which the first portion of the first metal plate overlays the first portion of the second metal plate in a region with a same pattern, and at least one of the first metal plate or second metal plate has a second portion extending away from the overlaying region, and wherein the second portion extending away from the overlaying region has a straight part and a curved part in which the curved part is further away from the overlaying region than the straight part.

2. The apparatus of claim 1, wherein the first metal plate and the second metal plate are disposed in parallel in a same pattern in at least one portion.

3. The apparatus of claim 1, wherein the second portion of one of the first metal plate or the second metal plate extends away from the overlaying region with the same pattern and does not overlay any portion of the respective first or second metal plate.

4. The apparatus of claim 1, wherein a second portion of one of the first metal plate or the second metal plate that extends away from the overlaying region with the same pattern is configured as a monopole antenna or an inverted F type antenna.

5. The apparatus of claim 1, wherein the first and second metal plate have different thicknesses.

6. The apparatus of claim 1, wherein the second metal plate comprises a feeding terminal electrically connected with the feeding portion of the main board and divided into a plurality of branches.

7. The apparatus of claim 1, further comprising a dielectric or a magnetic material interposed between the first metal plate and the second metal plate.

8. The apparatus of claim 7, wherein the dielectric or the magnetic material is interposed between the first metal plate and the second metal plate and disposed in at least one portion.

9. The apparatus of claim 8, wherein at least one of the first and second metal plates is a metal plate formed via insertion into the dielectric or the magnetic material while the dielectric or the magnetic material is molded.

10. The apparatus of claim 1, further comprising an injection molded material on the main board, wherein the first metal plate and the second metal plate are disposed on a carrier.

11. The apparatus of claim 10, wherein the first and second metal plates on the carrier together form a substantially planar configuration.

12. The apparatus of claim 1, wherein, with the main board beneath the first and second metal plates, the first metal plate is positioned on or under the second metal plate.

13. The apparatus of claim 1, wherein the first metal plate and the second metal plate comprise one Flexible Printed Circuit Board (FPCB).

14. The apparatus of claim 1, wherein only one of first metal plate and the second metal plate comprises an FPCB.

15. The apparatus of claim 1, further comprising a metal frame positioned along a periphery of the mobile terminal, wherein the first and second metal plates are each disposed in parallel along the metal frame.

16. The apparatus of claim 15, wherein the metal frame is electrically connected with the first metal plate and the second metal plate.

17. A built-in antenna apparatus of a mobile terminal, the mobile terminal including a main board having at least one feeding portion for feeding RF power and a plurality of grounding portions at ground potential, the antenna apparatus comprising:

a first metal plate and a second metal plate configured to be stacked on the main board and spaced from each other, wherein the second metal plate is electrically connected to the feeding portion and has a length sufficient to resonate in which the first metal plate and the second metal plate have a resonance characteristic for operation together where two rails harmonize, the two rails comprising one elongated conductor of the first metal plate and one elongated conductor from the second metal plate extending in parallel, and the first metal plate is electrically connected to the plurality of grounding portions and electromagnetically coupled with the second metal plate to resonate, a plurality of grounding terminals that extend from the first metal plate to be in contact with a respective grounding portion of the plurality of grounding portions wherein each of the first metal plate and the second metal plate has a respective first portion, in which the first portion of the first metal plate overlays the first portion of the second metal plate in a region with a same pattern, and at least one of the first metal plate or second metal plate has a second portion extending away from the overlaying region, and wherein the second portion of one of the first metal plate or the second metal plate that extends away from the overlaying region with the same pattern is configured in an open loop or a closed loop.

18. A built-in antenna apparatus of a mobile terminal, the mobile terminal including a main board having at least one feeding portion for feeding RF power and a plurality of grounding portions at ground potential, the antenna apparatus comprising:

a first metal plate and a second metal plate configured to be stacked on the main board and spaced from each other, wherein the second metal plate is electrically connected to the feeding portion and has a length sufficient to resonate in which the first metal plate and the second metal plate have a resonance characteristic for operation together where two rails harmonize, the two rails comprising one elongated conductor of the first metal plate and one elongated conductor from the second metal plate extending in parallel, and the first metal plate is electrically connected to the plurality of grounding portions and electromagnetically coupled with the second metal plate to resonate, a plurality of grounding terminals that extend from the first metal plate to be in contact with a respective grounding portion of the plurality of grounding portions wherein each of the first metal plate and the second metal plate has a respective first portion, in which the first portion of the first metal plate overlays the first portion of the second metal plate in a region with a same pattern, and at least one of the first metal plate or second metal plate has a second portion extending away from the overlaying region, and wherein the second portion of one of the first metal plate or the second metal plate that extends away from the overlaying region with the same pattern is configured in an open slot or a closed slot.

19. A mobile terminal having a built-in antenna, the mobile terminal including a main board having at least one feeding portion for feeding RF power and at least one grounding portion at ground potential, the built-in antenna comprising:

first and second metal plates configured to be stacked on the main board and spaced from each other, wherein the second metal plate is electrically connected to the feeding portion and has a length sufficient to resonate at a communication frequency of the mobile terminal, and the first metal plate is electrically connected with the grounding portion and electromagnetically coupled with the second metal plate to resonate, a plurality of grounding terminals that extend from a main orientation of the first metal plate to be in contact with the grounding portion, and wherein the first metal plate and the second metal plate have a resonance characteristic for operation together where two rails harmonize, the two rails comprising one elongated conductor of the first metal plate and one elongated conductor from the second metal plate extending in parallel, and wherein each of the first metal plate and the second metal plate has a respective first portion, in which the first portion of the first metal plate overlays the first portion of the second metal plate in a region with a same pattern, and at least one of the first metal plate or second metal plate has a second portion extending away from the overlaying region, and wherein the second portion extending away from the overlaying region has a straight part and a curved part in which the curved part is further away from the overlaying region than the straight part.

* * * * *